United States Patent [19]

Merz

[11] Patent Number: 4,780,960

[45] Date of Patent: Nov. 1, 1988

[54] PATTERN, PROCESS AND APPARATUS FOR OBTAINING A CUTTING TEMPLATE

[76] Inventor: Wolf Merz, Industriestrasse 32, CH-9430 St. Margrethen, Switzerland

[21] Appl. No.: 143,269

[22] Filed: Jan. 5, 1988

Related U.S. Application Data

[63] Continuation of Ser. No. 766,702, Aug. 19, 1988, abandoned.

[30] Foreign Application Priority Data

Sep. 18, 1984 [EP] European Pat. Off. ..... 84810456.8

[51] Int. Cl.[4] ..... A41H 3/00

[52] U.S. Cl. ..... 33/17 R; 33/12

[58] Field of Search ..... 33/12, 17 R, 11, 17 A

[56] References Cited

U.S. PATENT DOCUMENTS

| | | | |
|---|---|---|---|
| 82,740 | 10/1968 | Myers | 33/12 |
| 3,257,727 | 6/1966 | Berlin | 33/12 |

FOREIGN PATENT DOCUMENTS

| | | |
|---|---|---|
| 451279 | 10/1927 | Fed. Rep. of Germany . |
| 2002618 | 3/1971 | Fed. Rep. of Germany . |
| 2043959 | 3/1972 | Fed. Rep. of Germany . |
| 1055806 | 2/1954 | France . |
| 1138527 | 6/1957 | France . |
| 399676 | 10/1933 | United Kingdom . |

*Primary Examiner*—Harry N. Haroian
*Attorney, Agent, or Firm*—Wegner & Bretschneider

[57] ABSTRACT

When a pattern having a contour suitable for producing cutting templates is selected from existing patterns, these patterns (10, 30) are laid on top of one another, specifically in such a way that the reference zones (21, 51) and the reference points (20, 50) are located on top of one another. The position of selection mark (70) is then selected in relation to the contours of the said patterns. For example, that pattern having a contour nearest to the selection mark (70) can be conceded as usable.

In this way, existing patterns for producing new cutting templates relating to a specific part of a garment can be located and then also used.

4 Claims, 4 Drawing Sheets

PATTERN, PROCESS AND APPARATUS FOR OBTAINING A CUTTING TEMPLATE

Figure 1:
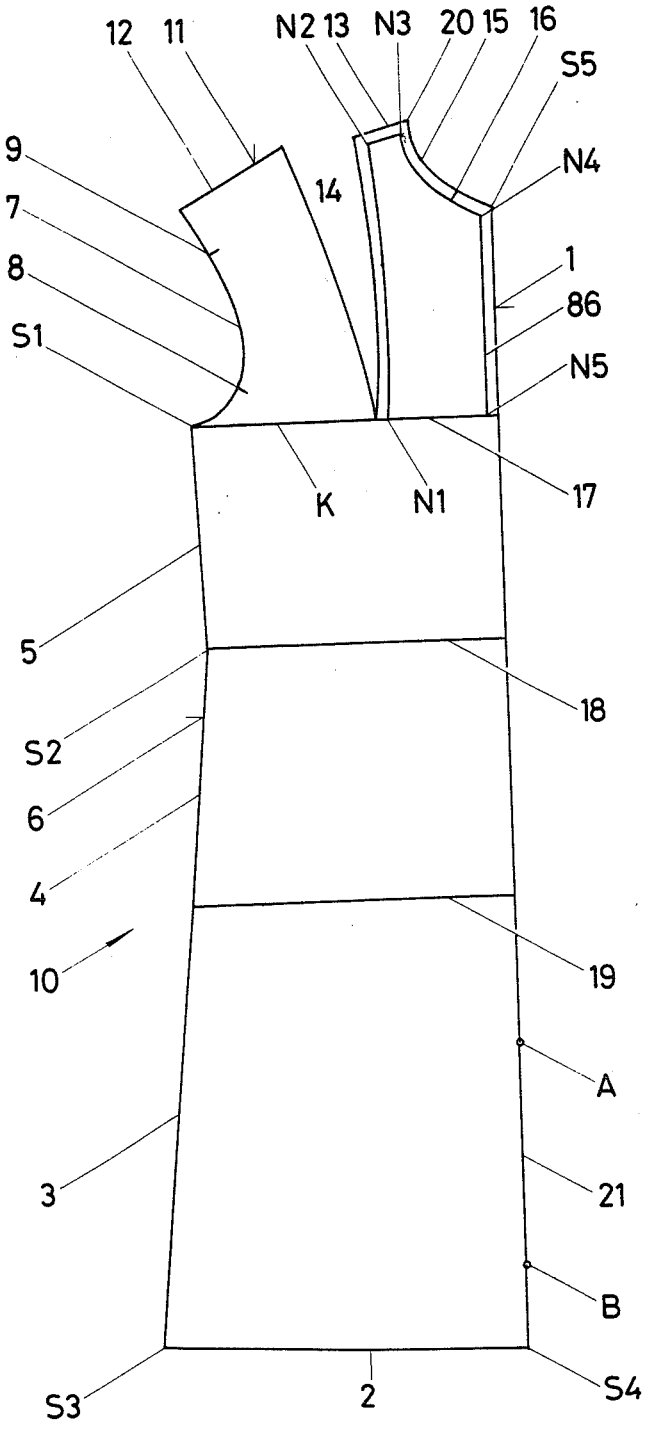

This application is a continuation of U.S. application Ser. No. 766,702, filed Aug. 19, 1985 now abandoned.

The present invention relates to a pattern for obtaining a cutting template which can be used to produce part of a garment, to a process for using this pattern and to apparatuses for carrying out this process.

As is known, a garment is a three-dimensional structure. To obtain this three-dimensional structure and its desired appearance, the garment is composed of individual parts of suitable contour. As a rule, such parts are called cut parts. The particular cut part consists of a suitable material and is initially sheet-like. The shape, length, etc of the individual portions of the segmented contour of the particular cut part are selected so that the desired three-dimensional structure, the garment and its desired appearance are obtained when specific portions of the contour of one of the cut parts are connected to the corresponding portions of the contour of further cut parts.

Selecting the contour of the cut parts so as to obtain a shape predetermined by the design of a garment or by a model of this presupposes a very high degree of experience and ability on the part of the person establishing the shape of the contour of the particular cut part. Furthermore, designing the contour of cut parts is very time-consuming work, and under certain circumstances it is also possible to waste a large amount of material.

As is known, cutting templates having the contour of the particular part of a garment are used in the factory production of articles of clothing. As a rule, such templates are made of a firm sheet-like material, so that the contour of the particular part of the garment can be transferred to the selected clothing material by tracing the contour of the template with a pencil, chalk or the like. With the aid of such cutting templates it is possible to produce economically cut parts which are then joined together to form the individual garments. The same essentially applies to the design of the contour of cutting templates as has already been said in relation to the design of the contour of cut parts.

As is known, there are garments having a basic shape which does not change over a long period of time. It has already been mentioned here that a garment consists of several cut parts. Again as already stated, cutting templates are used to produce these cut parts. If, in a garment of a specific type, only a single part of it changes, for example because of a new intended use of the garment or because of specific fashion influences, it would possibly be sufficient to change the contour of only that template or those templates of decisive importance for the changed part of the garment. The cutting templates for producing the remaining cut parts of a modified garment could be used unchanged to make the modified garment. Much effort and expense could be saved in this way.

There is even a further possibility. If the garment is modified in only a small region, to produce the cutting templates for making the appropriate and only partially changed cut part for the modified portion of the garment it will be possible to a large extent to use that pattern or those patterns which have been employed to produce the cutting templates already used earlier. Only the corresponding portion of the cutting template would have to be adapted, or the instructions for making the modified part of the cutting template would have to be reset if such cutting templates are produced automatically.

However, in practice, such an advantageous procedure is possible only when the production of a garment changed in only one detail follows immediately in time the production of the garment with the original appearance, since in this case all the cutting templates for producing the previous garment are still available. Usually, however, the production of the garment of a specific appearance is first discontinued, and a garment of similar appearance is produced only much later. The cutting templates of the garments produced previously are stored, for example, in the filing department. But in a relatively large concern, there can be an extremely large number of cutting templates in the files.

After a certain time, when an earlier type of garment is to be made with small changes, the previously produced cutting templates could be used as they are, or after an appropriate change in their contour, as patterns for making the cut parts which are now required. However, it is usually not possible to proceed in this way in practice, because, when there is a large number of cutting templates, it is very difficult to ascertain whether they include a cutting template of the desired contour or not. Instead of laboriously searching for the cutting templates already available in the files by means of a visual comparison with a desired contour, it is preferable to make all new cutting templates for a garment which is only partially changed. However, this is very costly work, as already explained above.

If the contours of the cutting templates already made are stored electronically, these contours, as patterns for producing new cutting templates, cannot even be located again by means of the visual comparison already mentioned. This is because there is still no known method making it possible to discover the reusable cutting templates or at least the contours of such templates.

The object of the present invention is to propose a process which makes it possible to discover from the existing patterns for cutting templates or cut parts those which can be used again.

In the process of the type mentioned in the introduction, this object is achieved, according to the invention, in the way defined in the characterizing clause of claim 1.

The object of the present invention is also to propose apparatuses suitable for carrying out the said process. The apparatuses according to the invention for carrying out the said process are likewise defined in the patent cover.

Figure 2:
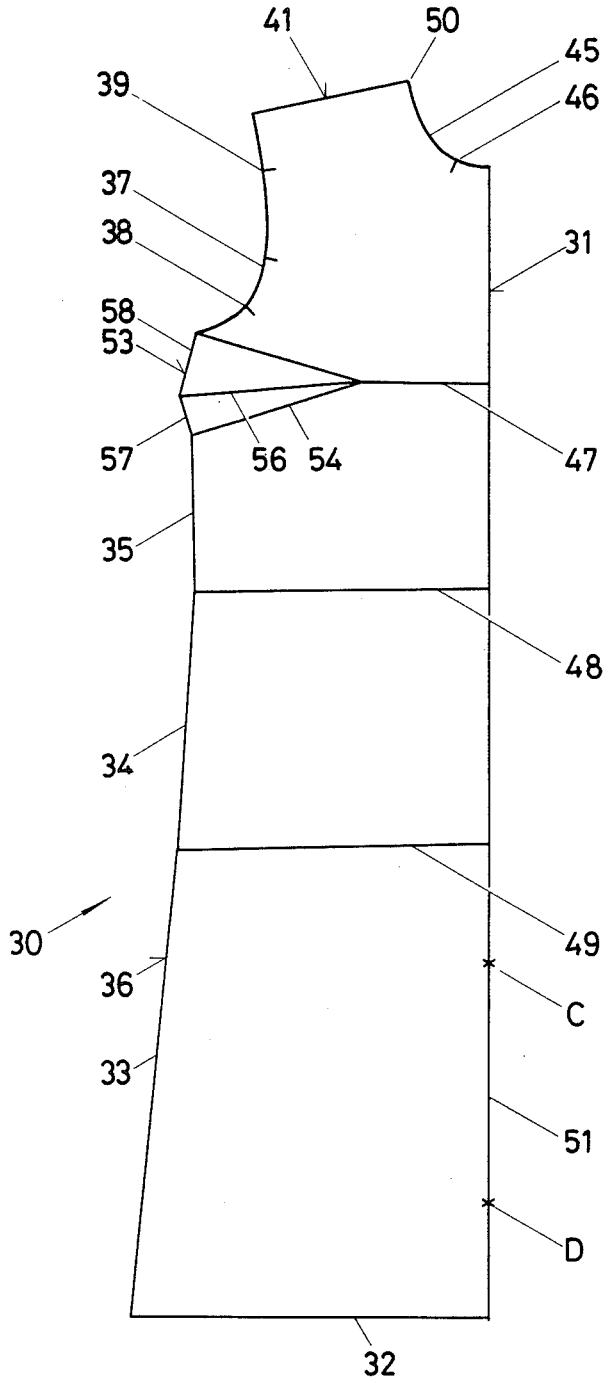
Figure 3:
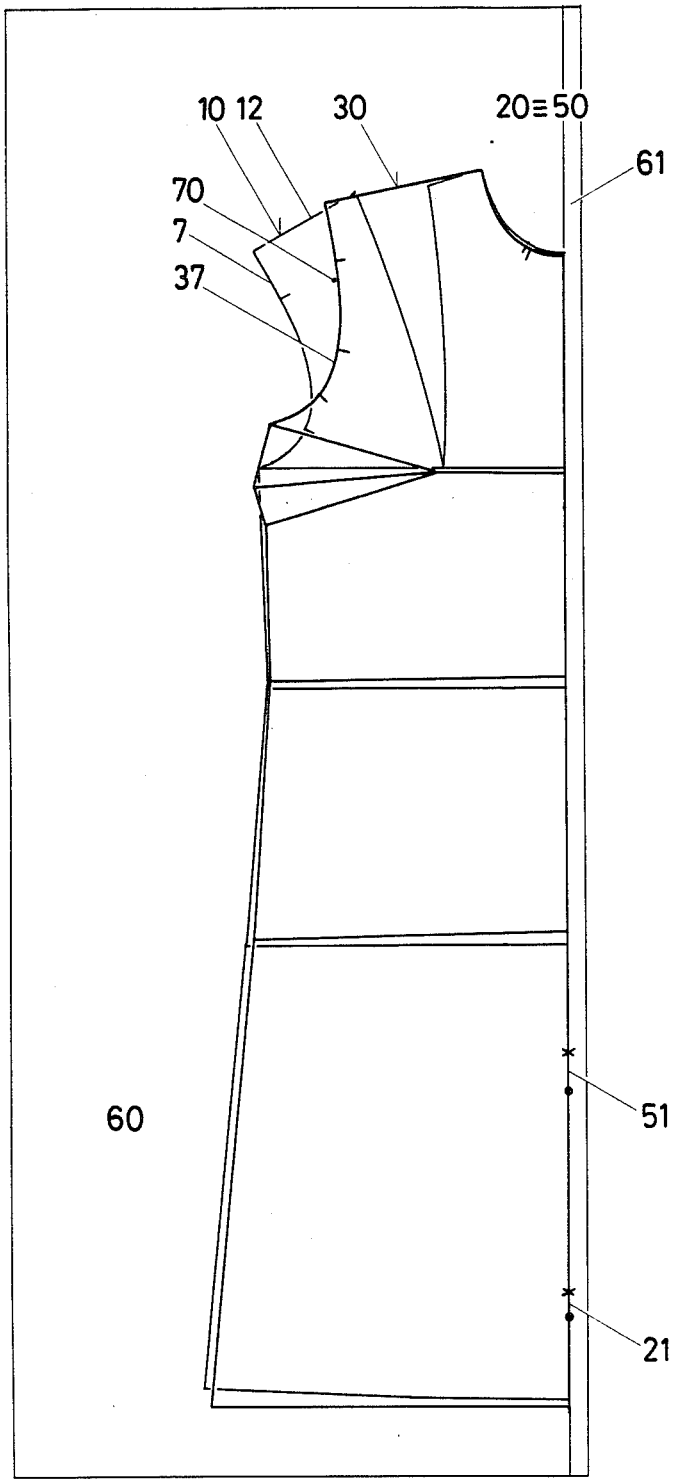
Figure 4:
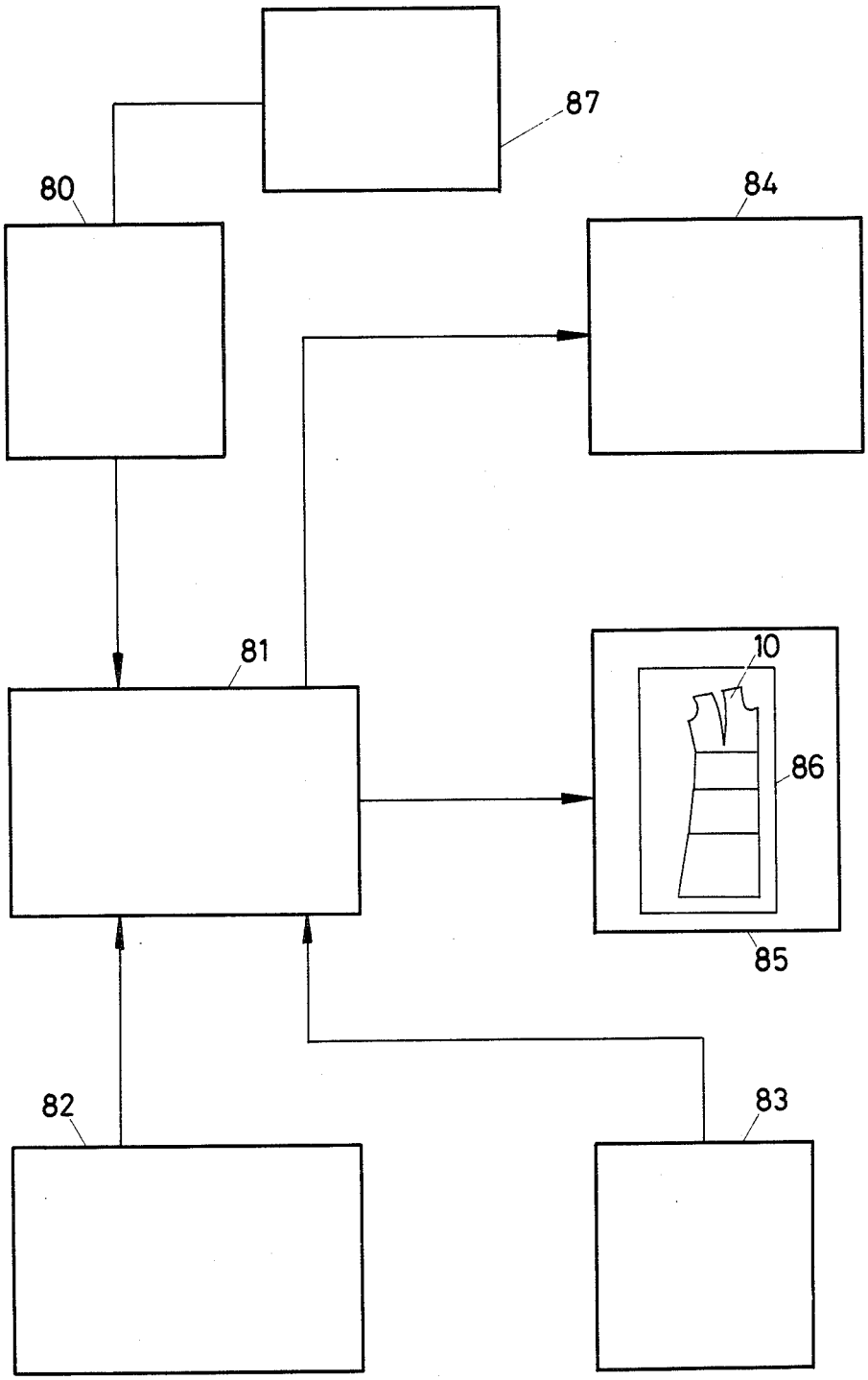

Exemplary embodiments of the present invention are explained in more detail below with reference to the attached drawings in which:

FIG. 1 shows the contour of a first cutting template which can be used to make the front part of a lady's dress, FIG. 2 shows the contour of a second cutting template which can likewise be used to make the front part of a lady's dress, the upper portion of the second dress being to a certain extent different from the corresponding portion of the dress mentioned in connection with FIG. 1, FIG. 3 shows the superimposed contours of the patterns illustrated in FIGS. 1 and 2, and, FIG. 4 shows diagrammatically a circuit which can be used to obtain the necessary cutting templates electronically.

The cutting template, the contour of which is illustrated in FIG. 1, can be used to make one of the front parts of a lady's dress. The longest and vertically extending line 1 of the contour of the cutting template 10 reproduces the front edge of the front part. The bottom-most line 2 extending approximately horizontally represents the hem of the front part. The line 6 located on the left and consisting of three zones 3, 4 and 5 defines the side seam on the front part of the dress. A line 7 limiting the rounded arm-hole portion adjoins this side seam 6 at the top. Incisions 8 and 9 serving as working markers are made in this edge 7 of the cutting template 10. Such markers are called notches and also serve as starting points or matching points during the assembly of parts, in order to compose the cut parts forming the garment so that they fit perfectly. The shoulder length 11 of the pattern 10 consists of two zones 12 and 13, a wedge 14 being cut out between these. Between the shoulder length 11 and the front edge 1 there is a rounded neck-hole portion 15, this edge 15 being provided with a notch 16. The line 17 uppermost in this cutting template 10 and extending approximately horizontally represents the chest width. Under it is the waist width 18 and under this the hip width 19. Between the second zone 13 of the shoulder length 11 and the rounded neck-hole portion 15 is the neck-hole tip 20 which will be mentioned again later. In the lower part of the front edge 1, a zone 21 is limited by two round marks A and B. This zone 21 will be referred to below as a reference line.

It is assumed here, for the purpose of further discussion, that the model of a garment has in each case been designed in a standard size, so that graded cutting templates for it are derived from the cutting template in the model size by one of the known methods. We also assume that cutting templates in the model size and the sets of graded cutting templates derived from them are stored separately from one another in the files. We further assume that further cutting templates in the model size, relating to the same part of garments modified in only one detail or in several details, are stored in the files or in an electronic memory. The cutting template or pattern 10 illustrated in FIG. 1 is a cutting template produced in the model size.

FIG. 2 illustrates a cutting template 30, in particular its contour, which is substantially similar to the template 10 shown in FIG. 1, as emerges from a comparison between the two Figures mentioned. Also where this second cutting template 30 is concerned, we assume that it is likewise produced in the model size.

The cutting template, the contour of which is illustrated in FIG. 2, can likewise be used to make one of the front parts of a lady's dress. The longest and vertically extending line 31 of the contour of the cutting template 30 reproduces the front edge of the front part. The bottom-most line 32 extending approximately horizontally represents the hem of the front part. The line 36 located on the left and consisting of three zones 33, 34 and 35 defines the side seam on the front part of the dress. Above the side seam 36 is a portion 37 of the contour of the cut part 30, this portion limiting the rounded arm-hole portion. Notches 38 and 39 are made in this edge 37 of the cutting template 30. A rounded neck-hole portion 45 is located between the shoulder length 41 and the front edge 31, this edge 45 being provided with a notch 46. The line 47 uppermost in this cutting template 30 and extending approximately horizontally represents part of the chest width. Under it is the waist width 48 and under this the buttock width 49. Between the shoulder length 41 and the rounded neck-hole portion 45 is the neck-hole tip 50 which will be referred to again later. In the lower part of the front edge 31, a zone 51 is limited by two crosses C and D which are referred to below as a reference line of the second cutting template 30.

A comparison between the two cutting templates 10 and 30 reveals that there are differences between these templates 10 and 30 in the chest region and in the shoulder region. There is no cut-out in the shoulder region, so that in the template according to FIG. 2 the shoulder length 41 is continuous. In the chest region, a gusset 53 adjoins the line 47 indicating the chest width and is limited laterally by the lines 54 and 55. The middle line 56 of this gusset 53 is a continuation of the chest width 47. The gusset 53 is limited at the front by two further lines 57 and 58.

We can now assume that the first cutting template 10 has served for making one of the cut parts of a model for a lady's dress already produced previously. A model, in which the front part is to appear as shown in FIG. 2 will now be produced. To make the cutting template 34 for such a cut part, it would be possible to a large extent to resort to that pattern or those instructions for the contour of such a pattern which were used to produce the cutting template 10 for making the cut part according to FIG. 1. It would merely be necessary to be in a position to locate the existing pattern for the cutting template 10 among all the remaining patterns already available.

This problem can be solved, for example, if cut parts or cutting templates are provided with systematic markings making it possible to compare contours and/or zones on cut parts of cutting templates relating to the same portion of a garment, for example all the front parts of a lady's dress, and select the suitable pattern or suitable instructions for producing the necessary cutting template. However, by means of the markings mentioned, graded cutting templates can also be obtained and produced, for example starting from a cutting template made in the model size.

It should be noted that the patterns for producing cutting templates can be in the form of either already finished cutting templates or stored electronic signals, these signals representing instructions for producing the contour of the particular cutting template.

Certain precautions must be taken to ensure that the said comparison between the patterns and the said selection of a suitable pattern can be made. In the first place, it is necessary to make sure that each of the existing patterns, for example the templates 10 and 30, assumes a quite specific position for the evaluation of the contour of the latter. The uniform position of the individual cutting templates can be guaranteed, for example, if the patterns 10, 30 etc are provided with means or marks which, as regards all the patterns relating to this part of a garment, are located in the same place on the patterns.

One of the components of such reference means can be, for example, zone 21 or 51 in the patterns 10 or 30, which coincides with a portion of the front edge 1 or 31 of the cutting templates for the front part of a dress. However, the reference zone or line can also be located within the contour of the particular pattern.

Nevertheless, as a result of the alignment of the particular pattern 10, 30, etc according to the said zone 21 or 51, etc, only the direction of the particular pattern is determined. This is because the patterns can assume any positions in the direction of these zones. To ensure that the existing patterns 10, 30, etc are located in the same place in the said direction, it is necessary to have a further component of the reference means, with which the patterns 10, 30, etc also have to be aligned. This further component of the reference means can be merely a point located on the particular pattern. In the arrangement illustrated, for example the neck-hole tip 20 or 50 of the patterns 10 and 30 illustrated in FIG. 3 can represent the additional component of the reference means. When the patterns are aligned according to the reference line and according to the reference point, they are in a position in which their contour can be evaluated for the purposes described here.

However, for example three or more points having the same relationship to one another in each pattern can also serve as reference means. Where three-dimensional patterns made of a solid material are concerned, these points can be formed, for example, as holes. If specific notches, for examples the notches 8, 9 and 16 were located in the same place in all the patterns, these notches could also serve as the said reference means or reference points for the patterns to be sorted.

After the uniform position of all the patterns for a cut part has been ensured, there must also be at least one further mark which can be selected in each individual case and the position of which decides whether a specific pattern is or is not relevant in the particular circumstances. This selection mark can be a simple point, its position in relation to the reference means 20 and 21 or 50 and 51 being selected according to the situation prevailing in the particular individual case. In FIG. 3, this selection mark is indicated by the point 70. The selection of the suitable pattern for producing a new cutting template will depend on the particular relationship between the position of the selection mark 70 and the contour of the existing patterns 10, 30, etc. The position of the selection point 70 in relation to the reference means 20, 21, 50 and 51 can be determined beforehand from specific facts not described in any more detail here.

The criterion for selecting the particular pattern which is suitable must also be defined. For example, according to this selection criterion, those existing patterns, the contour of which passes through the selection mark 70 or is nearest to this selection mark, are considered to be relevant. Then, in each of the existing patterns 10, 30, etc, the relationship between their contour and the selection mark 70 is examined. That pattern or those patterns which satisfy the selection criterion completely or as closely as possible are considered to be relevant, whilst the remaining patterns can be rejected. A suitable cutting template can then be produced by means of the selected pattern. If the contour of the selected pattern does not fully satisfy the said requirements, the relevant region of the pattern can be corrected and the modified pattern can then be used to produce a cutting template.

Since the position of the selection mark 70 is the same for all patterns having different contours, when the shape of the contour of the patterns to be evaluated is assessed they must all assume the same position, so that the different relationship between the contour of the particular pattern of the selection mark is evident.

Existing patterns 10, 30, etc are positioned, when their contours are evaluated, in such a way that the reference line 21 or 51 of the particular pattern and the reference point, for example the point 20 or 50, or the abovementioned three reference points, etc are located in a specific predetermined place. If the patterns 10, 30, etc are formed as templates made, for example, of cardboard, gauze, plastic or the like, such templates can be aligned according to the reference line 21, 51, etc in the simplest way if one of the edge parts of a table 60 (FIG. 3) for receiving the templates 10, 30, etc is provided with a stop 61 projecting from the receiving surface of the table 60. The templates 10, 30, etc are brought up against this stop 61 with their region or edge having the reference zone 21, 51, etc. This stop 61 represents one of the components of positioning means for the patterns.

However, in the example illustrated, the positioning means also have a positioning point which is made on the supporting surface 60 and on which thereference point of the particular pattern is located. In FIG. 3, the contours of the cutting templates or cut parts or patterns 10 and 30 are shown superimposed on one another, their contours being aligned not only according to the reference lines 21 and 51, but also according to the neck-hole tips 20 and 50. These neck-hole tips cover the positioning point on the supporting surface 60, with a result that the positioning point is not visible in FIG. 3.

As regards cutting templates made of the said materials, where the reference zone is located within the contour of the template, the reference zone can be designed, for example, as a slot in the template. A flat peg representing the first component of the positioning means for the patterns can be inserted through this slot. However, a light beam for aligning the individual templates according to their reference zone can also be used. Should this be necessary, in such cases at least one further component of the positioning means, for example a positioning point, can also be used, as already mentioned.

The shape of the contours of the existing patterns can be evaluated when the particular pattern is positioned individually according to the positioning and reference means, and when the degree to which the predetermined selection criterion is satisfied by the particular pattern put in position is analyzed on the basis of the relationship between the position of the selection mark and the shape of the pattern contour.

However, the shape of the contour of existing patterns can also be checked when all the patterns are first laid on top of one another and aligned relative to one another according to the positioning means and the reference line 21 or 51 and reference points 20 or 50. Then, a check can be made either simultaneously or on the individual patterns in succession to ascertain which of the patterns have a contour satisfying the selection criterion.

In the simultaneous check, all the patterns resting on one another can be provided with a continuous orifice 70 (FIG. 3) which can be made by pricking, by means of a drilling tool etc. The patterns are then separated from one another, and an inspection is made to ascertain which of the patterns has the orifice located on its contour or which of the patterns has the said orifice nearest to the pattern contour. However, the disadvantage of this method which is intrinsically very simple is that the patterns are damaged mechanically. This damage is most critical on those patterns in which the orifice is located on their contour, since this results in an irregularity in the shape of the contour of the cutting template to be produced according to this pattern or of the cut part to be made, even though it is precisely this pattern which would be the most suitable pattern of those examined.

The shape of the contour of each individual pattern can be checked, for example, if the patterns are positioned individually on the table 60. In this case, the reference line 21, 51, etc of the particular pattern 10, 30, etc comes up against the table stop 61 (FIG. 3). The neck-hole tip 20, 50, etc of the particular pattern is placed on the mark provided on the supporting surface of the table 60. Since this mark is covered by the neck-hole tip or tips, it cannot be seen in FIG. 3. For the actual examination it is possible to use a light beam which is directed, for example, perpendicularly to the table surface and which appears as a light spot on the surface of the particular pattern 10, 30, etc put in position. It is possible to conclude from the position of this light spot in relation to the contour of the particular pattern whether this pattern is relevant or not.

The contours in FIG. 3 are aligned according to the reference lines 21 and 51, but these lines 21, 51 do not have to be of the same length, nor is it necessary, although this can also serve as a further positioning mark, for the end points A and B of one reference line 21 to coincide with the end points C and D of the other reference line 51. In the example illustrated, the position of the patterns in the direction of the reference lines 21 and 51 is given when the neck-hole tips 20, 50, etc of all the patterns correspond to one another. The position of the selection mark 70 can now be derived, as already mentioned from predetermined facts. In the case illustrated, we assume that this selection mark 70 is located in that region of the picture according to FIG. 3 which is limited by the lines 7, 12 and 37. According to the selection criterion, that pattern in which the selection mark 70 is located within or on the contour of the pattern is considered to be relevant. Thus, in the example illustrated, the first pattern 10 would be relevant, since the selection mark 70 is located within its contour. The second contour 30 could be rejected.

However, the selection criterion can also state that that pattern having a contour nearest to the selection mark 70 is relevant. According to such a criterion, the second contour 30 would be relevant, because, as is evident from FIG. 3, the selection mark 70 is located nearer to the contour of the second pattern 30.

As already mentioned, the contours of the individual patterns 10, 30, etc can also be available as electronic and stored signals. The apparatus for carrying out the process in question has, in such a case, electronic storage means 80 (FIG. 4) which are connected to one of the inputs of a comparator unit 81. A unit 82 for inputting the selection mark 70 is connected to a second input of a comparator unit 81. Connected to a third input of the comparator unit 81 is a selection unit 83 which, controlled automatically or manually, can decide which of the patterns is selected as relevant.

A unit 84 for outputting the contour of that pattern satisfying the selection criterion as closely as possible is connected to a first output of the comparator unit 81. The comparator unit 81 can be provided-with a further output, to which is connected a unit 85 serving for the visual representation of the contour of the patterns, the selection mark and, if appropriate, also the positioning and reference means. This indicator unit 85 has a screen 86, on which the individual images or images superimposed on one another are displayed. The output unit 84 can be either a drawing instrument or, directly, a device for making cutting templates, for example, from a solid material.

The input means 82 for the selection mark 70 and the selection means 83 can be designed as a keyboard. The memory 80 and the comparator unit 81 are purely electronic units which contain circuits known per se for performing the said functions. Instead of the individual units 80 to 83 listed above, it is possible to use a single data-processing system which is designed so that it can perform the said functions.

The memory unit 80 serves for storing those signals which represent the contours of the patterns, the reference means 20, 21, 50, 51 of the patterns 10, 30 and the positioning means of the patterns. Where the contours are stored electronically, the said reference means can be represented in the same way as when the patterns 10, 30 are three-dimensional. Electronically, the reference means take the form of signals assigned permanently to those signals representing the particular pattern. Further signals related to the comparator unit 81 serve as positioning means, so that the reference means of those patterns, the signals of which enter the comparator unit 81, assume such a position in this comparator unit that the reference means of the particular pattern coincide electrically with the positioning means in the comparator unit 81. As a result of this, the reference means of all the patterns entering the comparator unit 81 are electrically at the same location in the comparator unit 81. This makes it possible to show the differences in the shape of the contours of the individual patterns, for example as a result of the patterns being superimposed.

The electronically stored contours which are displayed on top of one another according to the positioning and reference means produce an image of essentially the same appearance as that shown in FIG. 3. The solid base 60 and the mechanical stop 61 are of course omitted. The picture according to FIG. 3 was obtained when the two contours 10 and 30 from FIGS. 1 and 2 were superimposed. In practice, when there are several patterns for the same part of a garment, the superimposed image will naturally have several contours.

The memory unit 80 can have assigned to it a sensing unit 85 which is intended for sensing the contour of the particular pattern for the template and the marks or zones made on this. Such sensing units are generally known per seen and contain a solid base on which the pattern can be spread out. Furthermore, such a unit 87 contains an opto-electronic converter which converts the shape of the contour of the particular pattern and the position of the markings made on the latter into electrical signals which can be stored in the memory unit 80. Such signals are then used in the comparator unit 81 in the way already described above. Since the sensed pattern or sensed patterns have the reference means already mentioned, they do not need to have a specific position when the reference means are sensed, since because of the said reference means the patterns can be oriented automatically only when the reference means are evaluated by the machine.

The storage of the contour of existing patterns and of the marks or zones made on these presents further possibilities. In addition to the reference means, further marks can be made on the patterns 10, 30, etc. Such marks S1, S2, S3, S4 and S5 (FIG. 1) can be made at the corners of the contour of the particular pattern 10. The nature of these marks is such that the machine can detect that the marks are on the contour and in the particular corner of the pattern 10.

It has already been stated that the patterns 10, 30, etc are produced and stored in the model size, that is to say in an average size. Since it is known beforehand by how much the zone lying between two particular marks has to be increased or reduced to obtain a pattern for the cutting template in the next size of a garment, the entire set of templates from the smallest to the largest size of the particular part of the garment can be produced automatically by means of the machine, on the basis of the stored data relating to the pattern in the model size, when a numerically controlled device for producing cutting templates is connected to the apparatus illustrated in FIG. 4. Such devices are known, and such a device is described in Swiss Patent Application No. 3 208/84-6 (of 4th July 1984) by the same applicant.

The foregoing statements also apply when the pattern located among the existing patterns has to be initially modified. The changed pattern is first stored, and the said set of cutting templates can be produced on the basis of this stored pattern.

However, marks N1, N2, N3, N4 and N5 can also be made on the seam lines 86 of the particular pattern 10 for a cutting template. As is known, the seam line is located at a predetermined distance from the edge of the pattern or of the respective cut part. The said marks N on the seam lines 86 can thus be used in the same way as described in connection with the marks S on the contour of the pattern. Making marks N on the seam lines 86 affords the further particular advantage that the seam is designated by the said N marks and it can be recognized automatically by the machine. Markings made in this way also make it possible for the sewing device to detect the seam lines automatically when the parts of a garment are sewn together. Furthermore, such marks N or S can be used as marks for allocating the portions of the contour of an adjacent cut part of the same garment which are provided with identical or corresponding marks, when these portions are sewn together.

The said marks can also be made on other lines or zones of a pattern for a cutting template, such a mark K being shown on the construction line 17 in FIG. 1. Such marks S, N, K, etc can also serve for determining the dimensions of the stored patterns, since, during the already-mentioned sensing of a particular pattern for storing its contour and the markings made on this pattern, the distances between the individual marks of the markings are also sensed and stored. When specific marks are called up, the particulars relating to the distances between these marks can be obtained as an answer, and the dimensions of the patterns can also consequently be determined.

By means of the above-described sorting means, the patterns required can be selected from a quantity of existing patterns. The marking or grading marks S, N, K, etc on the patterns also make it possible, among other things, to prepare tables of dimensions automatically for the garments. Such tables of dimensions can then retroactively make it possible to grade patterns for the cutting templates. In the production of garments, the marking of seam lines makes it possible, for example, to achieve automatic calculation of the costs, automatic work preparation, automatic determination of sewing times, automatic calculation of the consumption of material and yarn, and uniform distribution of work in garment production.

I claim:

1. A process for storing, sensing and selecting a template for use in the production of a garment, comprising the steps of:

(a) providing each of a plurality of cutting templates with a reference line defined by first and second points and with a third reference point, the reference line and reference points being located in a constant relationship to one another and to the cutting template;

(b) storing the templates according to the position of said reference line and reference points;

(c) determining a selection criterion with respect to the position of the reference line and reference points of a template for use in the production of a particular garment; and (d) sensing the stored cutting templates, to select from among the plurality of templates the one template which most closely satisfies the selection criterion.

2. A process as recited in claim 1, wherein the cutting templates are provided with means for identification of at least one further property.

3. A process as recited in claim 1, wherein the reference line is designed as a slot and reference points are designed as holes in the cutting templates, or as electronically storable marks.

4. A process as recited in claim 2, wherein the means for identification are marks made at predetermined locations on the cutting template, said marks identifying at least the distance between them or between one of the marks and a predetermined location on the cutting template.

* * * * *